US005089827A

United States Patent [19]

Pizon

[11] Patent Number: 5,089,827

[45] Date of Patent: Feb. 18, 1992

[54] RECEIVING ANTENNA FOR A MOTOR VEHICLE

[75] Inventor: Ernest Pizon, Saint-Cloud, France

[73] Assignee: Mecaniplast, Clichy, France

[21] Appl. No.: 566,042

[22] Filed: Aug. 13, 1990

[30] Foreign Application Priority Data

Aug. 31, 1989 [FR] France ..... 89 11421

[51] Int. Cl.[5] ..... H01Q 1/32; H01Q 9/32

[52] U.S. Cl. ..... 343/715; 343/722; 343/749

[58] Field of Search ..... 343/722, 745, 749, 715, 343/900, 895, 850, 860

[56] References Cited

U.S. PATENT DOCUMENTS

| | | | |
|---|---|---|---|
| 2,931,034 | 3/1960 | Harrison et al. | 343/750 |
| 3,339,205 | 8/1967 | Smitka | 343/749 |
| 4,161,710 | 7/1979 | Kakurai | 343/749 |
| 4,167,011 | 9/1979 | Altmayer | 343/749 |
| 4,170,014 | 10/1979 | Sully | 343/749 |
| 4,439,772 | 3/1984 | Van Kol | 343/749 |
| 4,849,767 | 7/1989 | Naitou | 343/895 |
| 4,890,116 | 12/1989 | Lewis | 343/749 |

FOREIGN PATENT DOCUMENTS

| | | |
|---|---|---|
| 2035699 | 9/1978 | United Kingdom . |
| 2148604 | 10/1983 | United Kingdom . |

*Primary Examiner*—Michael C. Wimer

*Attorney, Agent, or Firm*—Cushman, Darby & Cushman

[57] ABSTRACT

A receiving antenna for a motor vehicle comprising a mounting (2) traversed by a bore (6) wherein there is fitted at one end an antenna element (1), and at its other end a conductor element (19, 20, 21, 22) intended to be electrically connected to the core of a coaxial cable (T), the antenna element (1) and the first conductor element (19, 20, 21, 22) Being electrically connected by electronic components (23) disposed inside the bore (6).

13 Claims, 2 Drawing Sheets

RECEIVING ANTENNA FOR A MOTOR VEHICLE

FIELD OF THE INVENTION

The present invention concerns a motor vehicle receiving antenna of the kind mounted in a base fixed to the vehicle body and which comprises an antenna element secured in a mounting fixed to the base.

PRIOR ART

More particularly, the antenna to be provided by the invention is of the kind where the mounting comprises an internal part traversed by a bore in which is fitted at one end the antenna element and at the other end a conductor element connected to the coaxial cable of the receiver, this internal part being itself surrounded by the wire of a coil which is electrically connected at one of its ends to the conductor element and at its other end to the antenna element, the internal part and this coil being surrounded by a cover fixed to the base.

OBJECT OF THE INVENTION

It is an object of the present invention to provide a new receiving antenna of this known kind, intended in particular to be associated with a car radio, to enable it to receive amplitude modulated (AM) signals on long wave, short wave, and/or medium wave bands, or frequency modulated signals (FM).

It is a further object of the invention to provide an antenna in which the length of the antenna elements used may be considerably reduced, whilst offering a wave reception quality equal to, or even better than, that of the already known antennas.

SUMMARY OF THE INVENTION

Thus the present invention provides a motor vehicle receiving antenna mounted on a base fixed to the body of the vehicle and comprising a mounting secured to the base, the mounting being traversed by a bore issuing in the base and having fitted therein at its end remote from the base an antenna element and at its other end a first conductor element intended to be electrically connected to the core of a coaxial cable, the bore being formed in an internal part made of an insulating material, the internal part being connected to a wire coiled on its external wall and connected at its ends to the antenna element and to the first conductor element, the internal part and the wire being surrounded by a cover made of an insulating material, and the antenna element and the first conductor element being electrically connected by electronic components disposed inside the bore.

Advantageously, the wire of the coil extends round the internal part along directions substantially parallel to the axis of the antenna mounting; on its outer surface the internal part is provided with ribs delimiting grooves between themselves, the ribs and grooves extending substantially along directions parallel to the axis of the antenna mounting, and the wire of the coil being disposed in the grooves around the said ribs. The wire of the coil comprises several intertwisted strands forming a Litz wire.

Preferably, the wire of the coil is flattened at one of its ends between the first conductor element and the inner wall of the bore. The wire of the coil may be flattened at one of its ends against the inner wall of the bore by a second conductor element, this second conductor element being in direct electrical contact with a conductive core of the antenna element. A said conductor element may comprise a hexagonal head which fits in a cut-out portion formed in the cover to secure the conductor element against movement such as translation. The cover may be a molded element which is shaped to fit about the internal part and each of the conductor elements which extends along a portion of the length of the internal part.

Moreover, the electronic components are advantageously ceramized components, placed end to end in the bore; the electronic components are pushed against each other by means of a spring; the electronic components are separated from the first conductor element by a capsule forming a capacitor; one electronic component is electrically equivalent to an inductor in series with a capacitor mounted in parallel with a diode, the diode being in the passing mode in the direction from the capacitor to the inductor.

BRIEF DESCRIPTION OF THE DRAWINGS

In order that the invention may more readily be understood, an embodiment thereof represented in the attached drawings, will now be described below in a purely illustrative and non-restrictive manner.

In these drawings.

DETAILED DESCRIPTION OF THE PREFERRED EMBODIMENTS

Figure 1:
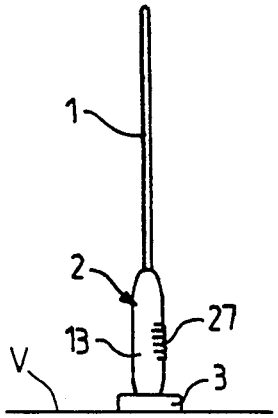
FIG. 1 is a schematic view of an antenna in accordance with the invention mounted on a vehicle body.

There will be seen in FIG. 1 an antenna in accordance with the invention comprising in essence an antenna element 1 secured in a mounting 2 fixed to a base 3 which is itself fixed to the body V of a vehicle.

Figure 3:
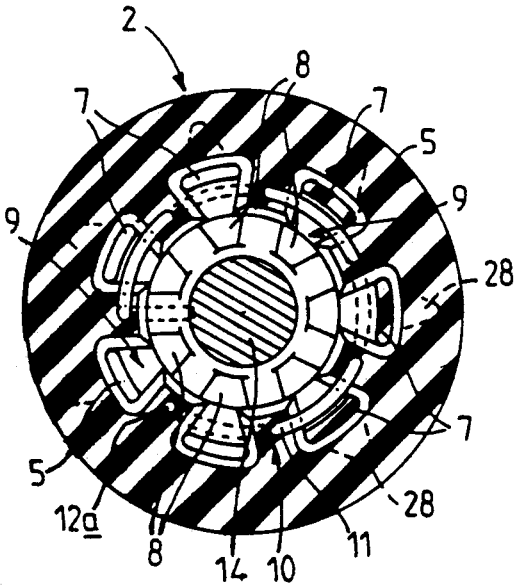
FIG. 3 is a sectional view, on an enlarged scale, along line III—III of FIG. 2.
Figure 2:
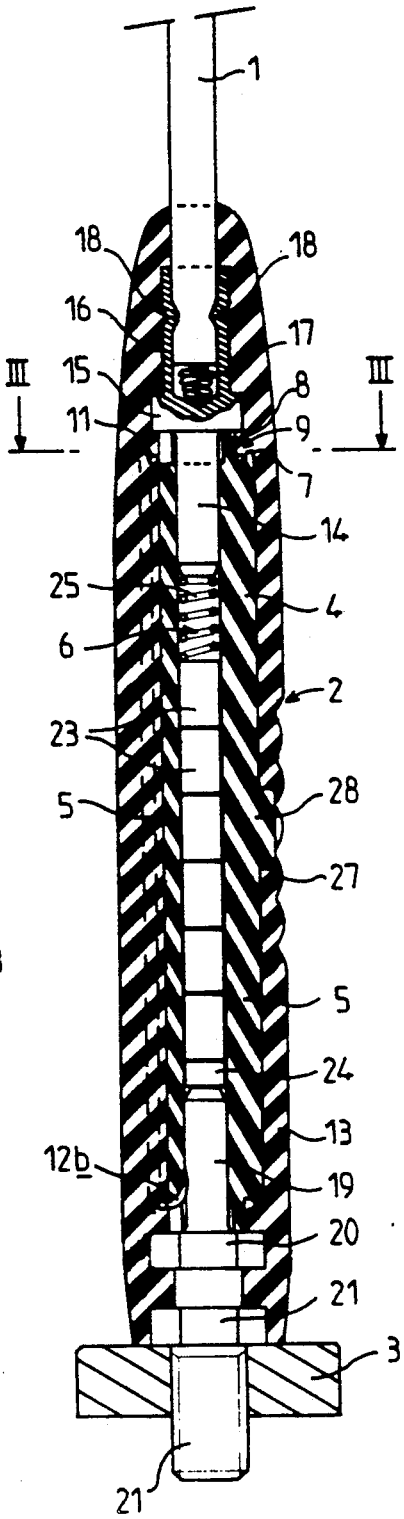
FIG. 2 is an axial sectional view of the same antenna with a partly stripped section in the region of the antenna element.

More precisely, it will be seen in FIGS. 2 and 3 that the mounting 2 comprises an internal part 4 which is substantially an elongate cylindrical sleeve whose outer wall is provided with longitudinal ribs 5 regularly distributed over its contour. This internal part 4 is traversed by a bore 6 coaxial with the antenna element 1. At each of the axial ends of the internal part 4, the ribs 5 are provided with circular arc-shaped rims 7 disposed in the extension of the outer sides of the ribs 5, as well as with tabs 8 disposed above the internal part 4 in the internal radial extension of the ribs 5 and which project axially in relation to the rest of the internal part 4, the rim 7 and the tab 8 associated with one and the same rib 5 delimiting a small passageway 9 between them. These ribs 5 are, moreover, provided substantially halfway up, with fins 28 projecting in relation to the ribs 5, these fins 28 having substantially triangular cross-sections. This internal part 4 is made of an insulating material and more particularly of glass fibre reinforced polycarbonate.

A Litz wire 11 is passed into the grooves 10 delimited by the ribs 5 between them, which wire passes through the grooves 10 from one axial end of the internal part 4 to the other, the said wire 11 being disposed in the region of the ends in the passageways 9. One of the ends of this wire 11, bearing the reference numeral 12*a*, is disposed within the bore 6 towards the end of the internal part 4 nearer the antenna element 1. The other end of this wire 11, bearing the reference numeral 12*b*, is disposed within the bore 6 towards the other end of the internal part 4. It should be noted that the internal diameters of these small cylinders, defined at the two ends of the part 4 by the tabs 8, are slightly greater than the inner diameter of the bore 6, which facilitates the positioning of the ends 12*a* and 12*b* of the Litz wire. This Litz wire 11 is a wire formed from 60 strands, each having a diameter of 6 hundredths of a millimetre and which are insulated from each other by a varnish, this wire being covered with a silk sheathing.

The internal part 4 and the Litz wire 11 are surrounded by a cover 13 which has a substantially cylindrical shape and whose interior forms a leakproof moulding for the part 4 and for the Litz wire 11, the internal part 4 being locked in relation to the said cover 13 by means of fins 28, this cover cap 13 being, moreover, fixed to the base 3 at its end nearer the latter in a leakproof way. This cover 13 is longer than the internal part 4 and has on its outer wall substantially halfway up circular arc-shaped serrations 27, substantially perpendicular to the axis of the mounting 2. These serrations 27 facilitate the gripping of the mounting 2 when the latter is positioned on the vehicle body V. This cover 13 is made of a synthetic rubber preventing any ingress of moisture and is marketed under the commercial designation of "Santoprene".

Inserted into the bore 6, towards the end of the internal part 4, nearer the antenna element 1, is a stem 14 terminating in a hexagonal head 15 which is extended on the side remote from the stem 14 in a sleeve 16 into which the antenna element 1 is fitted. The stem 14, head 15 and sleeve 16 form a single component made of an electrically conductive material, the head 15 bearing on the tabs 8 of the internal part 4 and being disposed in the tapered portion of the cover 13 which is farthest from the base 3, in an exactly complementary recess which prevents any movement of the stem 14 and of the sleeve 16 in relation to the cover 13. The antenna element 1 which includes a conductive core 17 disposed in a glass fibre reinforced plastic tube is force fitted in the sleeve 16 so that the conductive core 17 is flattened on the bottom of the sleeve 16, which bottom is formed by the head 15. In addition, the antenna element 1 is held in the sleeve 16 by an annular crimped portion 18 formed in the sides of the sleeve 16.

As a variant, the antenna element 1 may be made of a conductive material, for example a conductive rubber, and may not include any conductive core.

Inserted into a bore 6 at the opposite end to the antenna element 1 is a stem 19, substantially the same as the stem 14, which stem 19 ends in two side by side hexagonal heads; one of the heads bears the reference numeral 20 and is completely fitted within the cover 13 and the other bears the reference numeral 21 and is laterally fitted in the cover 13 and has one of its faces in contact with the base 3. The head 21 is, moreover, extended on the side remote from the stem 19 in a threaded socket 22 passing through the body V, this socket being for example, associated with a nut disposed on the other side of the body and holding the antenna unit in relation to the unit of the said body V. Moreover, this socket 22 is connected by a conventional connecting device (not shown) to the core of a coaxial cable. The stem 19, the heads 20 and 21 and the socket 22 form one and the same piece made of a metallic material, this piece ensuring the leakproof fixing between the cover 13 to the base 3, and hence between the mounting 2 and the base 3. Ceramic coated electronic components 23 are disposed in the bore 6 between the free ends of the stems 14 and 19, these components 23 being disposed in series one on top of the other between a capsule 24 made of an insulating material, for example a plastic material, and a spring 25 made of an electrically conductive material. The capsule 24 is disposed at the end of the stem 19 farthest from the head 20, and the spring 25 is compressed between the end of the stem 14 that is furthest from the head 15 and the components 23 which it pushes against one another. These components are electrically equivalent to microcircuits each comprising an inductor in series with a capacitor c mounted in parallel with a diode d, the diode d being in the passing mode in the direction extending from the capacitor towards the inductor.

Figure 4:
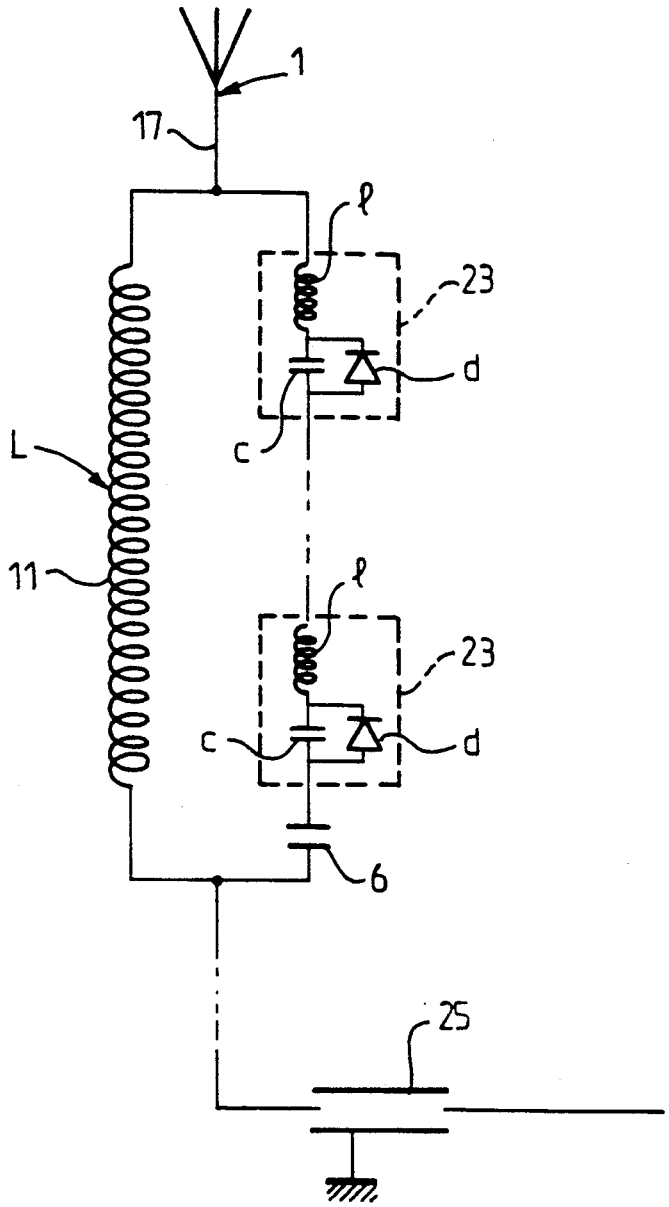
FIG. 4, finally, is a circuit diagram of the antenna.

FIG. 4 represents the electrical circuit diagram to which the antenna described above corresponds. This circuit comprises, in series with the antenna element 1, an inductor L formed by the coil of the Litz wire 11 wound round the internal part 4, as well as by the strands of the Litz wire which induce mutual inductances between themselves. This inductor L is mounted in parallel with, on the one hand, N electronic components 23, and, on the other hand, a capacitor C formed by the capsule 24 disposed between the components 23 and the metallic stem 19. This circuit is itself mounted in series with the coaxial cable of the connector, the cable being surrounded by an earthed metallic braiding T.

Thus disposed, this circuit serves as the signal transformation circuit, the N electronic components 23 making it possible, in particular, to transform a modulated amplitude signal into an aggregate signal corresponding to the upper envelope of the initial signal whereto there has been added a slight ripple. It should be noted that with such a circuit it is possible to use a 40 cm long antenna element, whilst the usual antenna elements are approximately 80 cm in length. The reception quality is altogether equivalent to that obtained with the usual longer antennas.

I claim:

1. A receiving antenna for a motor vehicle comprising:

a base adapted to be fixed to the body of the said motor vehicle, mounting means secured to said base, said mounting means having an internal part made of insulating material, means defining a bore in said internal part with said bore extending through said base, said mounting means having an end remote from said base and another end with an antenna element fitted in said mounting means at said end thereof remote from said base, a first conductor element disposed at said another end and for connection to the core of a coaxial cable, said internal part having an external wall and a wire coiled about said external wall and connected to said external wall, said wire having opposite ends with one end connected to said antenna element and the opposite end connected to said first conductor element, said mounting means and said first conductor element having a cover made of insulating material with said internal part and said wire being nested within said cover, where the improvement comprises said antenna element and said first conductor element being electrically connected by electronic component means disposed in said bore and said electronic component means disposed in said bore and said electronic component means includes an inductor in series with a capacitor mounted in parallel with a diode, said diode being in the passing mode in the direction from said capacitor to said inductor.

2. An antenna according to claim 1, wherein said wire encircles round said internal part along directions substantially parallel to the axis of said mounting means.

3. An antenna according to claim 1 or wherein said internal part is provided on its outer surface with ribs defining grooves, said ribs and said grooves extending substantially along directions parallel to the axis of said mounting, and said wire being disposed in said grooves around said ribs.

4. An antenna according to claim 1 wherein said wire comprises several intertwisted strands forming a litz wire.

5. An antenna according to claim 1 wherein said wire is flattened at one of its ends between said first conductor element and the inner wall of said bore.

6. An antenna according to claim 1 wherein said wire is flattened at one of its ends against the inner wall of said bore by a second conductor element; and including means placing said second conductor element in direct electrical contact with a conductive core of said antenna element.

7. An antenna according to claim 5 wherein said first conductor element comprises a head disposed in a cut out of the cover securing said conductor element against movement.

8. An antenna according to claim 6, wherein said second conductor element comprises a head disposed in a cut out of the cover securing said second conductor element against movement.

9. An antenna according to claim 5 wherein said cover is molded to conform to said internal part and to said first conductor element.

10. An antenna according to claim 6 wherein said cover is molded to conform to said internal part and of said second conductor element.

11. An antenna according to claim 1, wherein said electronic components are ceramic coated components, placed end to end, one on the other in the bore.

12. An antenna according to claim 11, including spring means pushing said electronic components against each other.

13. An antenna according to claim 1 wherein said, electronic components are separated from said first conductor element by a capsule forming a capacitor.

* * * * *